US012662836B2

(12) United States Patent
Cord et al.

(10) Patent No.: US 12,662,836 B2
(45) Date of Patent: Jun. 23, 2026

(54) AUTOMATIC PARKING SYSTEM AND ASSOCIATED MOTOR VEHICLE PARKING METHOD

(71) Applicant: Stanley Robotics, Versailles (FR)

(72) Inventors: Aurélien Cord, Paris (FR); Mathieu Lips, Paris (FR)

(73) Assignee: Stanley Robotics, Versailles (FR)

( * ) Notice: Subject to any disclaimer, the term of this patent is extended or adjusted under 35 U.S.C. 154(b) by 187 days.

(21) Appl. No.: 18/261,610

(22) PCT Filed: Jan. 20, 2022

(86) PCT No.: PCT/FR2022/050113

§ 371 (c)(1),
(2) Date: Aug. 21, 2023

(87) PCT Pub. No.: WO2022/157459

PCT Pub. Date: Jul. 28, 2022

(65) Prior Publication Data

US 2024/0392600 A1 Nov. 28, 2024

(30) Foreign Application Priority Data

Jan. 22, 2021 (FR) ..... 2100608

(51) Int. Cl.
*E04H 6/12* (2006.01)
*E04H 6/14* (2006.01)
*E04H 6/42* (2006.01)

(52) U.S. Cl.
CPC ..... *E04H 6/424* (2013.01); *E04H 6/14* (2013.01)

(58) Field of Classification Search
CPC ..... E04H 6/14; E04H 6/24; E04H 6/424
USPC ..... 52/174
See application file for complete search history.

(56) References Cited

U.S. PATENT DOCUMENTS 2,874,857 A * 2/1959 Coursey ..... E04H 6/14 414/231
5,267,822 A * 12/1993 Paravia ..... E04H 6/225 414/280
6,085,124 A * 7/2000 Choi ..... E04H 6/422 700/214

(Continued)

FOREIGN PATENT DOCUMENTS

CN 108798118 A 11/2018
CN 209976112 1/2020
CN 112177401 A 1/2021

OTHER PUBLICATIONS

International Search Report for International Application No. PCT/FR022/050113 dated May 11, 2022, 3 pages.

(Continued)

*Primary Examiner* — James J Buckle, Jr.
(74) *Attorney, Agent, or Firm* — TraskBritt

(57) ABSTRACT

An automatic parking system comprises at least one carousel-type parking tower comprising pods each comprising a storage tray for storing a vehicle, the system comprising at least one transport conveyor so as to carry or deposit the vehicle, and support means for at least partially supporting the weight of the pod receiving a conveyor and a vehicle, wherein the parking system may comprise several parking towers in a row. The present disclosure also relates to a method for controlling the towers and the at least one conveyor.

9 Claims, 5 Drawing Sheets

(56) References Cited

U.S. PATENT DOCUMENTS

| | | | | |
|---|---|---|---|---|
| 6,189,272 | B1 * | 2/2001 | Deiss | E04H 5/06 182/132 |
| 6,212,832 | B1 * | 4/2001 | Gao | E04H 6/285 52/174 |
| 10,689,874 | B2 * | 6/2020 | Tang | E04H 6/422 |
| 12,180,740 | B2 * | 12/2024 | Monteverdi | E04H 6/424 |
| 2009/0313095 | A1 * | 12/2009 | Hurpin | G06Q 20/127 705/13 |
| 2011/0320035 | A1 * | 12/2011 | Kharkover | E04H 6/22 700/218 |
| 2013/0085596 | A1 * | 4/2013 | Shani | G08G 1/14 414/231 |
| 2015/0175354 | A1 * | 6/2015 | Kharkover | E04H 6/225 414/807 |
| 2018/0171655 | A1 * | 6/2018 | Scherer | G08G 1/146 |
| 2018/0258663 | A1 * | 9/2018 | Maier | E04H 6/422 |
| 2024/0375529 | A1 * | 11/2024 | Cord | B60L 53/16 |
| 2025/0003246 | A1 * | 1/2025 | Cord | E04H 6/24 |

OTHER PUBLICATIONS

International Written Opinion for International Application No. PCT/FR022/050113 dated May 11, 2022, 7 pages.

Chinese First Office Action and Search Report for Application No. 202280015849.9 dated Jan. 29, 2026, 14 pages with English translation.

* cited by examiner

AUTOMATIC PARKING SYSTEM AND ASSOCIATED MOTOR VEHICLE PARKING METHOD

CROSS-REFERENCE TO RELATED APPLICATIONS

This application is a national phase entry under 35 U.S.C. § 371 of International Patent Application PCT/FR2022/050113, filed Jan. 20, 2022, designating the United States of America and published as International Patent Publication WO 2022/157459 A1 on Jul. 28, 2022, which claims the benefit under Article 8 of the Patent Cooperation Treaty of French Patent Application Serial No. FR2100608, filed Jan. 22, 2021.

TECHNICAL FIELD

The present disclosure relates to the field of motor vehicle parking structures of the carousel or vertical tower type comprising mobile vehicle spaces. It furthermore relates to electric handling vehicles, in particular, autonomous conveyors for transporting or moving four-wheeled vehicles.

BACKGROUND

In the state of the art, it is known to use vehicle carousel-type parking towers; these are called "carousel parking," "stereo garage," "stereo parking," "APS" (acronym for "automated parking system"). This type of tower comprises a frame carrying several pods, each pod corresponding to a space in which to park a motor vehicle. The tower further comprises a transport means that carries and translates the pods in a closed path along the frame. These parking spaces increase the number of vehicles parked for a given floor area.

In operation, a person drives the vehicle to be parked, from the entrance of the tower to the empty platform of a pod arranged on the ground level of the tower. The distance traveled is only a few meters. The transport means is then controlled so as to translate the pods along the frame in order to place other vehicles into other empty pods or to return a parked vehicle to its owner. The tower comprises a single entrance allowing a vehicle to enter or exit.

Although satisfactory, it is nevertheless desirable to improve the safety of persons, in particular, operators and customers, allow faster loading and unloading from the customer's point of view, and optimize the number of parked vehicles for a given floor area.

It is also known to have several towers of the carousel type next to each other so that all the entrances of the towers open onto the same street. It is also known to arrange the towers back-to-back.

In parallel, document CN108798118 discloses a carousel-type parking device and an omnidirectional transport carriage adapted to the carousel. The carriage carries a vehicle from a dock to the ground level of the tower in order to place the transported vehicle on an empty pod of the carousel. Each pod comprises four pairs of rods, each pair of rods being provided to receive one wheel of the vehicle. Once the vehicle has been deposited on the rods of a pod, the carriage can pass through the pod.

This device has the disadvantages of the need for loading and/or unloading platforms, which increases the area necessary for the correct operation of the parking structure, and relatively long installation time due to the presence of rods as vehicle support means. In addition, in the event that the carriage fails, it is not possible to place or recover a vehicle manually via a physical person.

The present disclosure therefore aims to improve the care of vehicles in order to offer a faster and more secure service for people to optimize the space available.

BRIEF SUMMARY

According to a first aspect, the present disclosure relates, according to its most general sense, to a method for parking motor vehicles of an automatic parking system enabling vehicle storage and retrieval.

The parking system comprises at least two carousel-type parking towers, each tower comprising:

- a vertical frame having a number N of pod spaces, and on the ground level of a tower entrance and exit for a vehicle to pass through,
- at least N−1 pods connected to the frame, each pod being connected to a pod space, each pod comprising a storage tray corresponding to a parking space of a motor vehicle, and having a pod entrance and a pod exit for the vehicle to pass through, and
- a means for actuating the pods translationally in a closed path along the frame.

Each pod is intended to be loaded or unloaded when it is placed on the ground level of the parking tower.

The at least two towers are arranged one behind the other: at least one passage tower and one destination tower so that a tower exit of a passage tower is facing a tower entrance of the next tower so that a vehicle can pass directly from one tower to another, and defining a number R, R being equal to at least 2, of rows of parking towers, the destination tower being positioned at least at row 2.

The parking system comprises at least one four-wheeled vehicle transport conveyor comprising wedging arms, arranged to be positioned on either side of the treads of the wheels of the vehicle so as to carry or deposit the vehicle, the at least one conveyor comprising an autonomous guiding means.

The parking system further comprises control means arranged to control the actuation means of the at least two parking towers and the means for autonomous guidance of the at least one conveyor.

According to the present disclosure, the method comprises:

- a step of choosing a pod, referred to as target pod, of a destination tower, for storing or retrieving a vehicle,
- a step of controlling the actuation means of the at least two towers, comprising the movement of the pods of the destination tower to place the target pod on the ground level, and the movement of the pods of the at least one passage tower, so as to align an empty pod or the empty pod space of the at least one passage tower with the target pod of the destination tower,
- a step of controlling the movement of the at least one conveyor, carrying a vehicle or being empty, to pass through the at least one passage tower, and access the target pod of the destination tower to store or retrieve the vehicle.

According to alternative embodiments, the method may further comprise one or more of the following steps:

- a step of detecting an empty pod or an empty pod space on the ground level of the at least one passage tower before the step of controlling the movement of the at least one conveyor, a step of detecting the at least one conveyor during the passage over a storage tray or the ground level of a passage tower comprising an empty pod space, a step of identifying the at least one conveyor during the passage over a storage tray or the ground level of a passage tower comprising an empty pod space, wherein the parking system comprises a means of wireless communication between the control means and the means for guiding the conveyor, a step of transmitting the address of the target pod to the at least one conveyor, wherein the parking system comprises a number L, L being equal to at least 2, of lines of parking tower, arranged next to each other, each line of parking towers comprising the number R of rows of parking towers, wherein the parking system comprises at least one transport conveyor per line of parking towers, the method comprising a step of controlling the simultaneous movement of at least two conveyors.

According to a second aspect, the present disclosure relates to an automatic parking system for storing and retrieving motor vehicles, comprising at least one carousel-type parking tower comprising:

a vertical frame having a number N of pod spaces, and on the ground level of a tower entrance and exit for a vehicle to pass through, at least N−1 pods connected to the frame, each pod being connected to a pod space, each pod comprising a storage tray corresponding to a parking space of a motor vehicle, and having a pod entrance and a pod exit for the vehicle to pass through, a means for actuating the pods translationally in a closed path along the frame, each pod being loaded or unloaded when it is placed on the ground level of the tower.

According to one embodiment, the at least one carousel-type parking tower comprises N pods connected to the frame, so that all the pod spaces are occupied by a pod as defined above.

According to another embodiment, the at least one carousel-type parking tower comprises N−1 pods connected to the frame, so that a single pod space is unoccupied, called the empty pod space.

The parking system comprises at least one four-wheeled vehicle transport conveyor comprising wedging arms, arranged to be positioned on either side of the treads of the wheels of the vehicle so as to carry or deposit the vehicle, the at least one conveyor comprising an autonomous guiding means.

The parking system comprises control means arranged to control the actuation means and the means for autonomous guidance of the at least one conveyor.

The parking system further comprises support means arranged on the ground level of the at least one tower, the means being arranged to at least partially support the weight of a transport conveyor carrying a vehicle.

The support means are arranged to at least partially support the weight of the pod receiving a conveyor and a vehicle.

The support means are arranged to allow the transport conveyor to pass through a tower without having to go up or down any stairs.

Preferably, the support means project from the surface of the ground level of the parking tower.

According to a first embodiment, the system comprises an empty pod space, and the support means comprise a platform protruding from the ground level of the at least one tower. For example, the platform comprises support means acting vertically so that the platform is a retractable platform. The platform is retractable between:

a passage position of a transport conveyor, a position in which the surface of the platform is flush with the step or threshold at the tower entrance and the step or threshold at the tower exit, and a support position of a pod during a loading or unloading of a vehicle by a transport conveyor arranged on the storage tray.

According to a second embodiment, the system comprises N pods, and the support means comprise load-absorbing rollers protruding from the ground level of the at least one tower. The rollers make it possible to support a pod during a loading or unloading of a vehicle by a transport conveyor arranged on the storage tray.

Preferably, the support means comprise resilient return means, for example, springs. In the case of springs, each rotation axis of a load-absorbing roller is mounted on springs. Each axle end is connected to the floor or to the frame by means of a spring acting vertically so as to allow a slight vertical displacement of the roller when a conveyor that is or is not carrying a vehicle goes by. Each spring is, for example, connected to a rotationally fixed ring or bearing, the ring or the bearing carrying an axis of a load-absorbing roller.

Preferably, the system comprises at least two parking towers arranged one behind the other: at least one passage tower and one destination tower so that a tower exit of a passage tower is facing a tower entrance of the next tower so that a conveyor that is or is not carrying a vehicle can pass directly from one tower to another, and defining a number R, R being equal to at least 2, of rows of towers, the destination tower being positioned at least at row 2.

The term "next tower" refers to another passage tower or the destination tower.

The at least one transport conveyor allowing transport from or to a parking tower comprises a telescopic chassis provided with a rolling and propulsion means, and comprising wedging arms arranged to position itself on either side of the tread of a wheel of the vehicle to be loaded.

Optionally, the transporter comprises means for detecting the clamping of a vehicle wheel comprising at least one sensor and a clamping detection computer that collects the data from the at least one sensor and generates a signal representative of the mobility state of the vehicle according to the data.

BRIEF DESCRIPTION OF THE DRAWINGS

The present disclosure will be better understood from reading the following description, which refers to one non-limiting exemplary embodiment illustrated by the accompanying drawings, in which.

DETAILED DESCRIPTION

Figure 2:
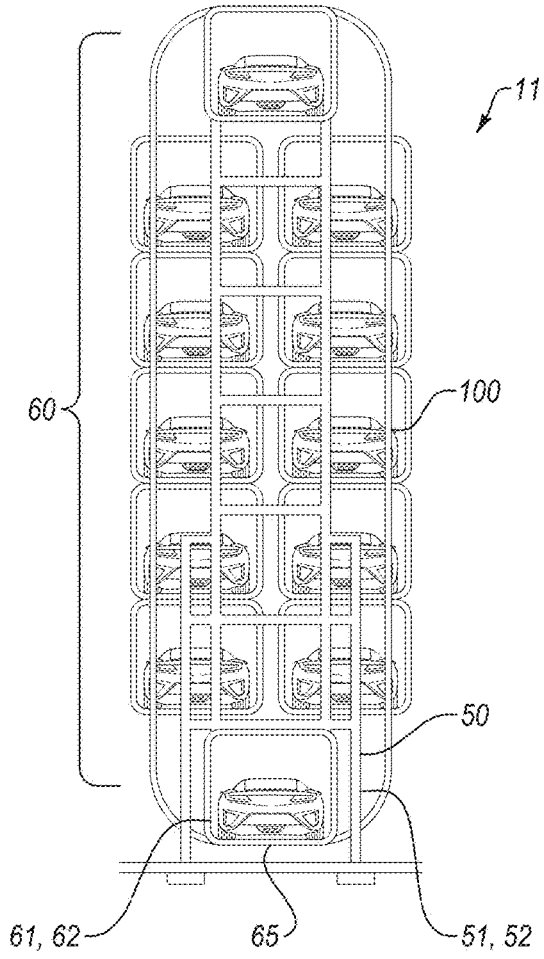
FIG. 2 shows a front view of a carousel-type parking tower according to one embodiment, the tower comprising a vertical frame having a tower entrance and exit, and comprising a plurality of pods, each pod having a pod entrance and a pod exit and storing a vehicle.

FIG. 2 shows an automatic parking system for parking motor vehicles comprising a carousel-type parking tower 11. The tower allows for the storage and retrieval of motor vehicles 100.

According to the embodiment shown, the tower comprises a vertical frame 50 having twelve pod spaces. The frame further comprises on the ground level a tower entrance 51 and a tower exit 52 for the passage of a transport conveyor carrying, or not carrying, a vehicle. The frame is arranged and configured to have opening dimensions of the tower entrance and the tower exit allowing a transport conveyor to pass through the tower. Depending on the direction of travel, a tower entrance 51 may be a tower exit 52 and vice versa.

The tower comprises twelve pods 60 connected to the frame 50. Each pod comprises a structure connected to a pod space. In this embodiment, the tower has as many pods as there are pod spaces. Each pod 60 comprises a storage tray 65 corresponding to a parking space of a motor vehicle 100. Each pod has a pod entrance 61 and a pod exit 62 for the vehicle to pass through. The pod is loaded or unloaded when it is placed on the ground level of the tower, as shown in FIG. 2. The structure of each pod is arranged and configured to have opening dimensions of the pod entrance and the pod exit allowing a transport conveyor to pass through the pod. Depending on the direction of travel, a pod entrance 61 may be a pod exit 62 and vice versa.

For the foregoing and for the rest of the description, a loaded pod is understood to mean a pod occupied by or storing a vehicle. In addition, an unloaded pod is understood to mean a pod that is empty or unoccupied by a vehicle.

FIG. 2 shows a carousel-type parking tower having several floors and comprising 12 pods and arranged in two columns. According to other embodiments, the parking towers may, for example, comprise between 6 and 20 pods arranged in two columns.

Figure 3:
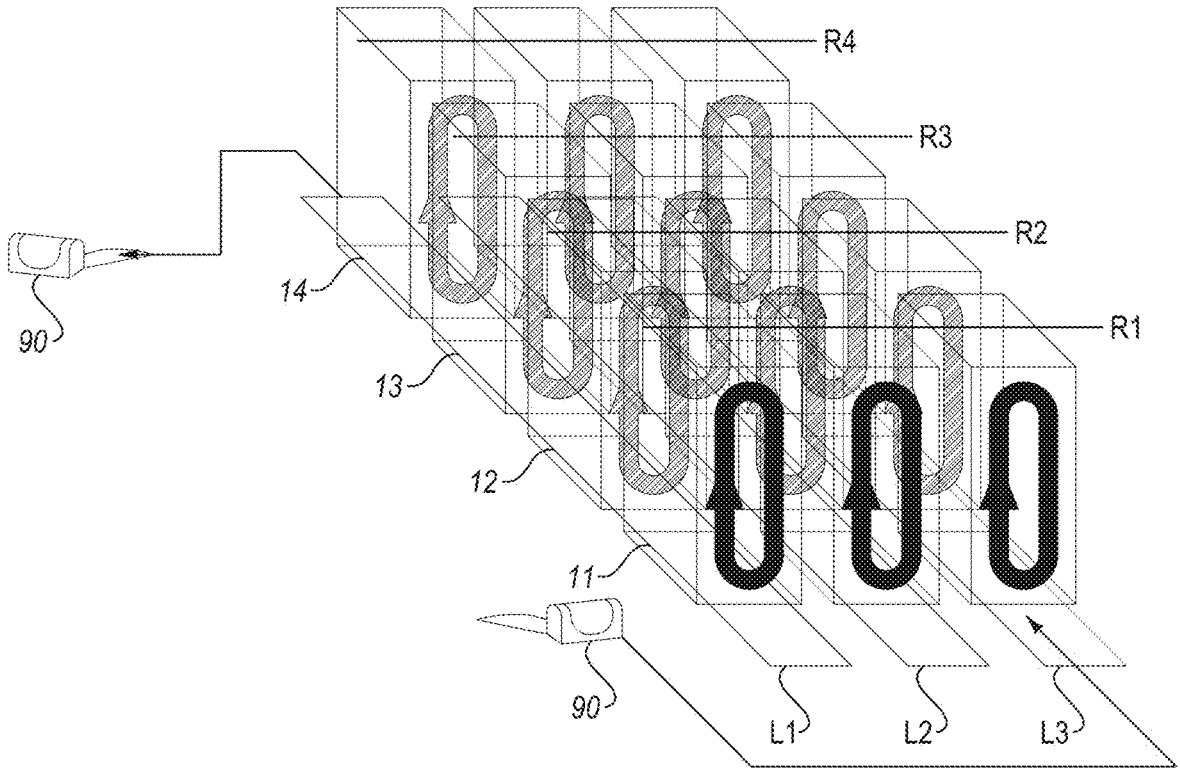
FIG. 3 shows a schematic perspective view of an automatic parking system according to one embodiment comprising three lines of carousel-type parking towers, arranged next to each other, each line comprising four rows of parking towers.

In order to move the pods, the parking tower comprises a means for actuating in translation (not visible in the figures) pods according to a closed path along the frame, the path being illustrated in FIG. 3, which shows several carousel-type parking towers. The actuation means, for example, comprises at least one actuator and connection means enabling the pods to be pulled along the vertical frame of the tower.

The parking system comprises at least one transport conveyor 90. Each transport conveyor is arranged to roll on the floor and, in particular, on the ground level of the carousel-type parking tower. Each transport conveyor is further arranged to pass through a pod by going through a pod entrance 61 and a pod exit 62 by rolling on the storage tray 65, see FIG. 1.

Figure 7:
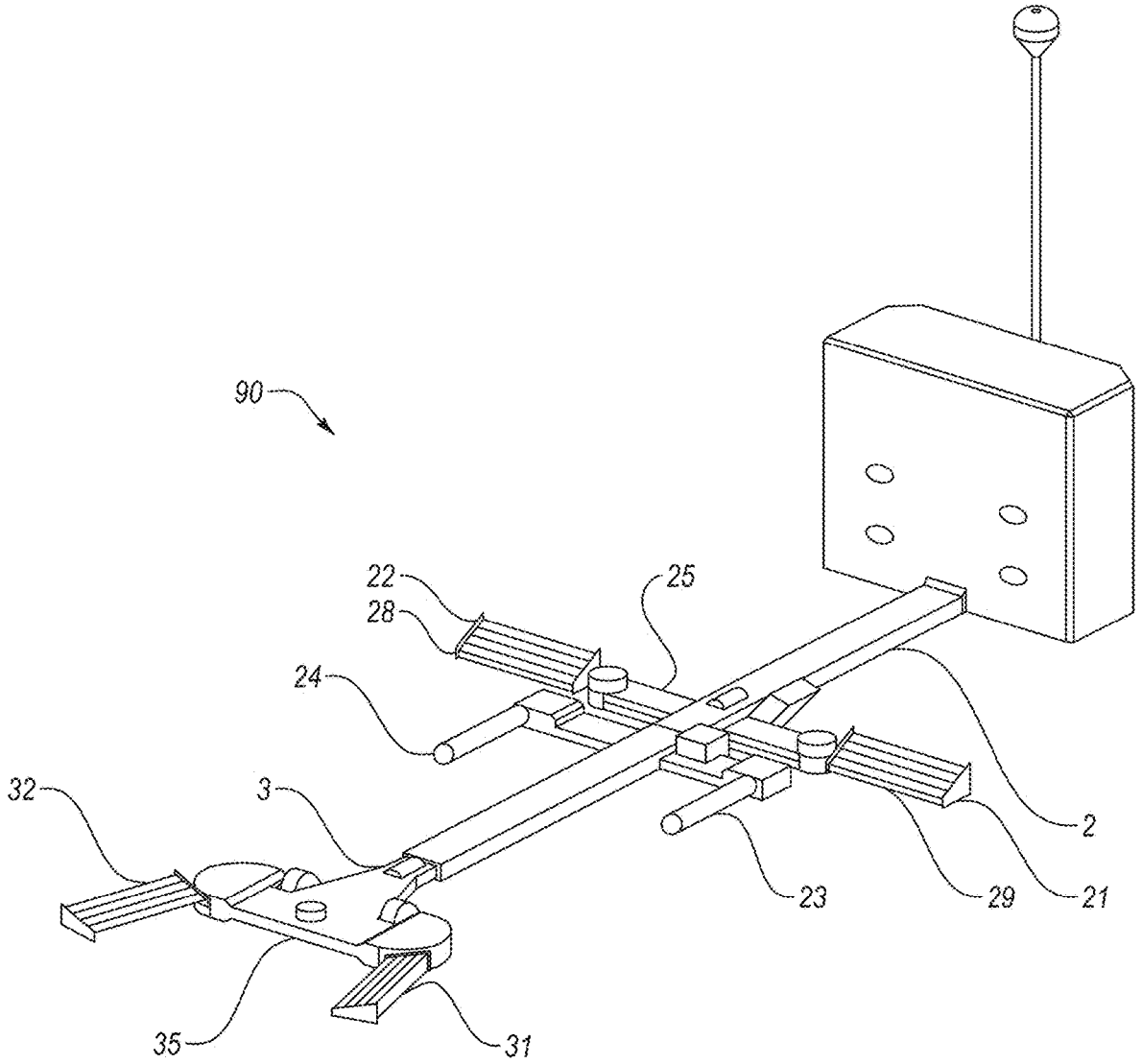
FIG. 7 shows a schematic perspective view of a transport conveyor according to an exemplary embodiment of the present disclosure, the conveyor comprising two pairs of front wedging arms and one pair of rear wedging arms.

Each transport conveyor 90 is arranged to lift the four wheels of a motor vehicle so as to carry the vehicle. According to one embodiment shown in FIG. 7, the at least one conveyor comprises wedging arms 21, 22, 23, 24, 31, 32, arranged to be positioned on either side of the treads of the wheels of the vehicle so as to carry or deposit the vehicle.

The transport conveyor 90 comprises a chassis comprising a main beam 2 and a secondary beam 3 that is mounted slidably inside the main beam 2. A cylinder or a linear actuator (not shown), for example, a worm gear actuator, allows the secondary beam 3 to be actuated relative to the main beam 2 in order to obtain a telescopic chassis.

The main beam 2 of the chassis comprises a front transverse side member 25, which is fixed and which bears two fixed arms 21, 22 and two deployable front arms 23, 24, which are pivotably movable relative to the front side member. The deployable front arms 23, 24 are actuated by electric motors or cylinders, in order to move between:

- a neutral position, in which the deployable front arms extend parallel to the main beam in order to allow the transporter to drive under the vehicle to be loaded without touching the wheels of the vehicle; and
- a deployed locking position, in order to allow contact with the treads of the wheels of the vehicle.

In the deployed position, the spacing between each pair consisting of a fixed arm and a facing deployable arm 21, 23 and 22, 24 is determined so that they come into contact with the front and rear walls of the tire of the vehicle and grip the tire in order to allow the vehicle to be lifted. To facilitate lifting, the fixed arms 21, 22 have an inclined ramp 28, 29.

When the deployable front arms 24, 23 are in the deployed locking position, they stop the vehicle from moving relative to the transport conveyor 90.

The secondary beam 3 of the chassis likewise comprises a rear transverse side member 35, which bears two deployable rear arms 31, 32 that are pivotally movable relative to the rear side member. The deployable rear arms 31, 32 are actuated by electric motors or cylinders, in order to move between:

- a neutral position, in which the deployable rear arms extend parallel to the secondary beam in order to allow the transporter to drive under the vehicle to be loaded without touching the wheels of the vehicle; and
- a deployed locking position, in order to allow contact with the treads of the wheels of the vehicle.

The length L of the side members 25, 35, measured between the pivot shafts of the deployable front arms 23, 24 and of the deployable rear arms 31, 32 is less than Vmin-Lmin, where:

Vmin denotes the typical and minimum track of a car, typically 1600 millimeters, Lmin denotes the typical width of the tire of a car, typically 220 millimeters.

The length L of the side members is therefore typically less than 1400 millimeters, and preferably about 1200 millimeters.

The length of the fixed arms 21, 22, of the deployable front arms 23, 24 and of the deployable rear arms 31, 32 is determined so as to correspond to half of the width lmax, which corresponds to the width between the outer walls of the wheels of a large car, minus the length of the side member 25, 35, which is typically 500 millimeters for each of the arms.

The conveyor may thus be positioned along the axis of the vehicle, when the conveyor is running on a storage tray 65, in order to allow the chassis of the conveyor to pass under the vehicle with the wedging arms 23, 24, 31, 32 in the folded position, oriented substantially longitudinally, until the ramps 28, 29 of the fixed arms 21, 22 abut the front wheels of the vehicle.

The deployable wedging arms 31, 32 are then moved into the transverse position. The secondary beam of the chassis is actuated forward in order to adjust to the wheelbase of the car to be loaded and to bring the deployable wedging arms 31, 32 into contact with the rear treads of the wheels of the vehicle.

The wedging arms 23, 24 are deployed to move the vehicle onto the fixed arms 21, 22.

Figure 8:
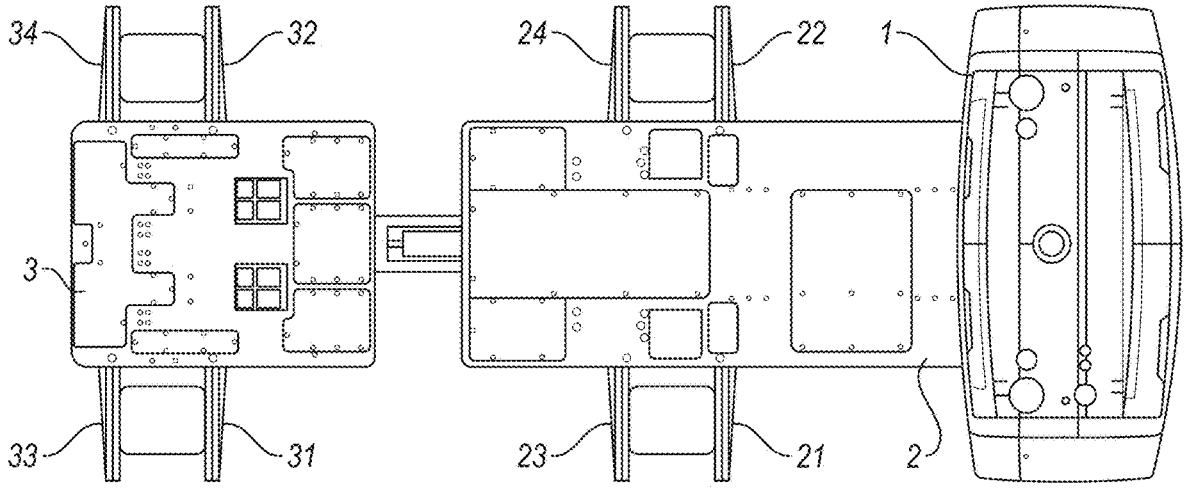
FIG. 8 shows a schematic top view of a transport conveyor according to a second embodiment of the present disclosure, the conveyor comprising two pairs of front wedging arms and two pairs of rear wedging arms, schematically illustrating wheels of a motor vehicle to be loaded.

According to a variant embodiment and in a complementary manner shown in FIG. 8, the secondary beam 3 of the chassis further comprises two deployable distal arms 33, 34 that are pivotally movable relative to the rear side member. The deployable distal arms are actuated by electric motors or cylinders, in order to move between:

- a neutral position, in which the deployable distal arms extend parallel to the secondary beam 3 in order to allow the transporter to drive under the vehicle to be loaded without touching the wheels of the vehicle; and
- a deployed locking position, in order to allow contact with the treads of the wheels of the vehicle.

In the deployed position, the spacing between each pair of arms consisting of a rear arm 31, 32 and a facing distal arm 31, 33 and 32, 34 is determined so that they come into contact with the front and rear walls of the tire of the vehicle and grip the tire in order to allow the vehicle to be lifted. When the deployable distal arms 34, 33 are in the deployed locking position, they stop the vehicle from moving relative to the conveyor.

In a manner not shown, the at least one transport conveyor comprises a guide means allowing it to be moved autonomously. Furthermore, the parking system comprises control means arranged to control the actuation means and the means for autonomous guidance of the at least one conveyor.

The presence of a transport conveyor added to the presence of a vehicle on the storage tray of a pod causes an overweight for the structure of the pod.

Figure 4:
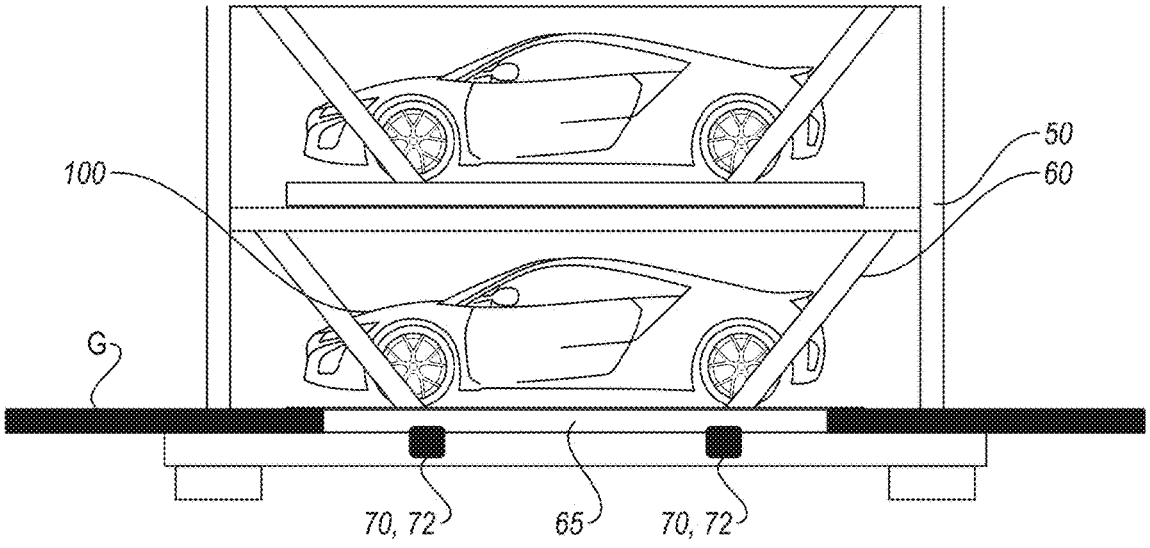
FIG. 4 shows a side view of the ground level of a carousel-type parking tower comprising as many pods as pod spaces and comprising support means according to a first embodiment, the means comprising rollers and being arranged on the floor and protruding upward to receive the lower face of a storage tray of a pod.
Figure 5:
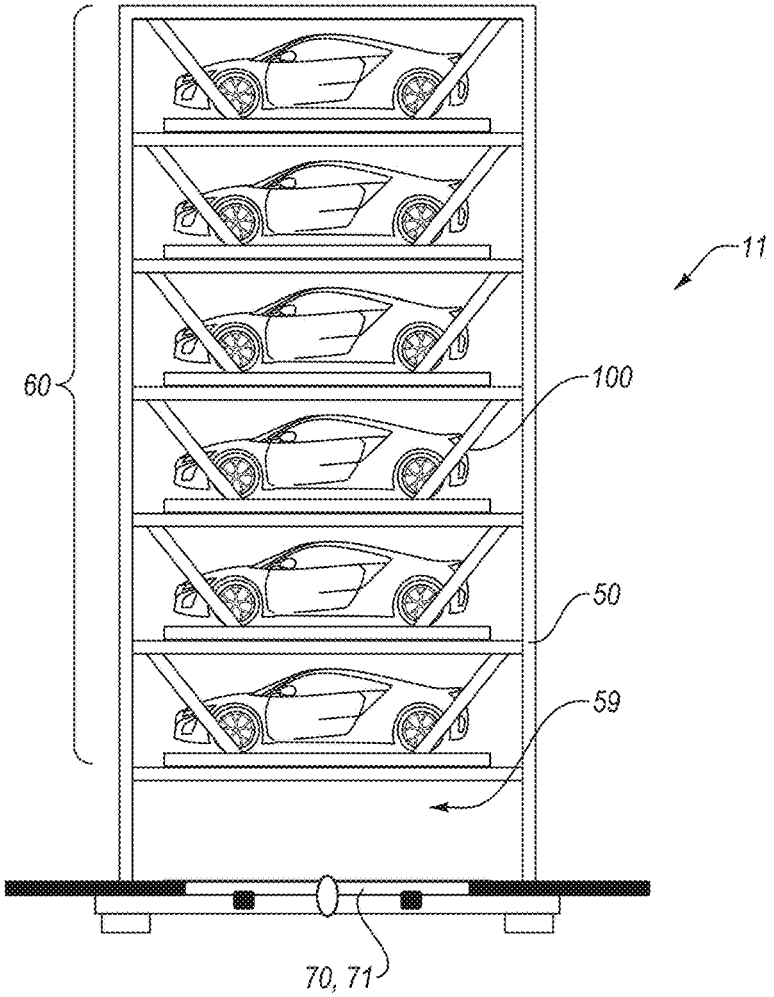
FIG. 5 shows a side view of a carousel-type parking tower comprising N−1 pods and one empty pod space, and comprising support means according to a second embodiment, the means comprising a retractable platform arranged on the ground and able to move vertically to receive the lower face of a storage tray of a pod or a transport conveyor.

With reference to FIGS. 4 and 5, the parking system further comprises support means 70 arranged on the ground level of the at least one tower. The means are arranged to at least partially support the weight of a transport conveyor 90 carrying a vehicle 100. A transport conveyor can then pass on each pod, making it possible to propose an automatic parking system offering faster service that is safer for people.

With reference to FIG. 4, a pod 60 is positioned on the ground level of a carousel-type parking tower, the tower comprising as many pods as pod spaces. The tower comprises N pods and N pod spaces. The support means 70 comprise load-absorbing rollers 72 protruding from the ground level of the at least one tower. The rollers make it possible to support the pod 60 during a loading or unloading of a vehicle by a transport conveyor (not shown) arranged on the storage tray.

With reference to FIG. 5, a carousel-type parking tower comprises N−1 pods 60 and an empty pod space 59. The support means 70 comprise a platform 71 protruding from the ground level of the at least one tower.

Preferably, the automatic parking system comprises at least two parking towers of the carousel type arranged one behind the other: at least one passage tower and one destination tower so that a tower exit of one tower is opposite a tower entrance of the next tower so that the at least one conveyor 90 carrying or not carrying a vehicle can pass directly from one tower to another. This set of towers defines a number R, R being equal to at least 2, of rows of towers, the destination tower being positioned at least in row 2. The at least two carousel-type parking towers are aligned so as to form a line.

Figure 1:
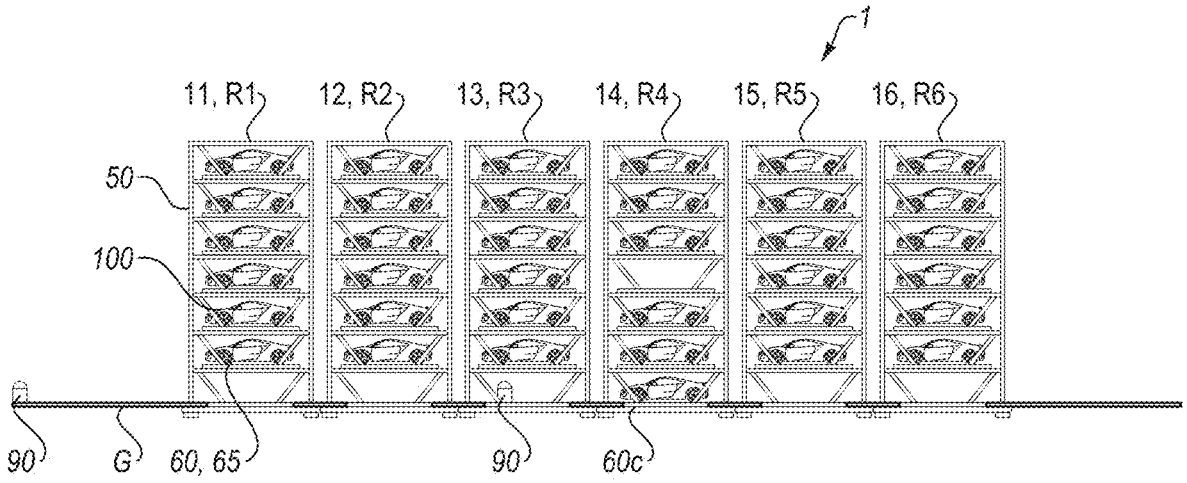
FIG. 1 shows a side view of an automatic parking lot system according to one embodiment, the system comprising a set of carousel-type parking towers arranged one behind the other in a row, defining six rows of towers, the towers containing motor vehicles, and a transport conveyor running on the ground level of the parking towers.

According to one embodiment shown in FIG. 1, the automatic parking system comprises six carousel-type parking towers 11, 12, 13, 14, 15, 16 aligned in the longitudinal direction of the towers and defining six rows of towers R1, R2, R3, R4, R5, R6. According to this embodiment, each parking tower comprises as many pods as pod spaces. To access a pod, referred to as a target pod 60*c*, of a destination tower, the transport conveyor rolls on the storage trays of the empty pods of the passage towers, the empty pods being arranged on the ground level of the passage towers.

With reference to FIG. 1, the target pod 60*c* is located in the parking tower 14, in this case called a destination tower, the tower being located in row 4 of the parking system. The transport conveyor 90 enters through the entrance of the parking tower 11 and then rolls onto the empty pods of the parking towers 11, 12 and 13 before accessing the parking tower 14. In this case, the parking towers 11, 12 and 13 are passage towers. Then, not shown, the transport conveyor rolls on the storage tray of the target pod 60*c* by fitting under the vehicle. The vehicle is lifted and carried by the conveyor 90. The transport conveyor 90, carrying the vehicle, exits the target pod by rolling on the storage trays of the empty pods.

According to an alternative embodiment shown in FIG. 3, the automatic parking lot system 1 comprises a number L, L being equal to three, lines L1, L2, L3 of carousel-type parking towers, arranged next to each other, each line of parking towers comprising four rows R1, R2, R3, R4 of parking towers.

Figure 6:
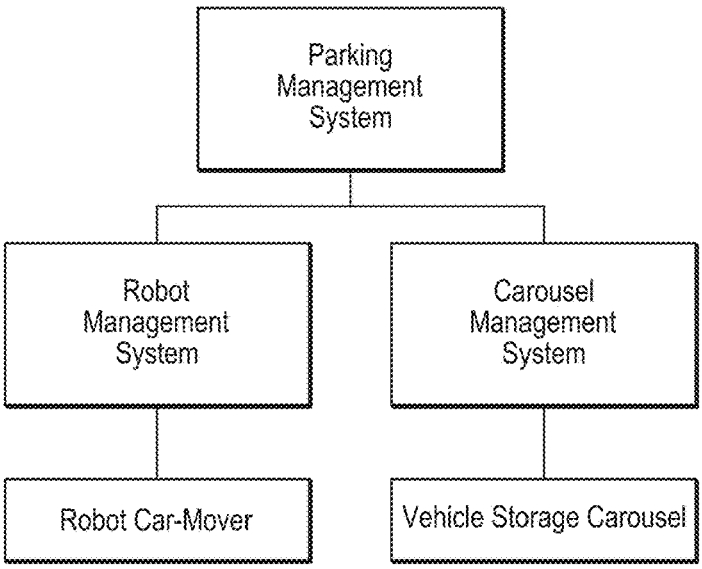
FIG. 6 shows a diagram of the method for controlling the actuation means of the carousel-type parking towers and means for guiding the transport conveyors.

The parking control method associated with the automatic parking system, with reference to FIGS. 1 and 6, will now be described.

The method provides for:

- a step of choosing a target pod 60*c*, referred to as target pod, of a destination tower, for storing or retrieving a motor vehicle 100,
- a step of controlling the actuation means of the four parking towers 11, 12, 13 and 14, comprising:
- moving the pods 60 of the destination parking tower 14 to place the target pod 60*c* on the ground level, and
- moving the pods of one or more of the three passage parking towers 11, 12 and 13 so as to align an empty pod of each passage tower with the target pod 60*c* of the destination parking tower 14,
- a step of controlling the movement of the empty transport conveyor 90, to pass through all the passage parking towers 11, 12 and 13, and access the target pod 60*c* of the destination parking tower 14 to retrieve the vehicle from the target pod 60*c*.

Preferably, the control means of the parking system, also called a parking management system, comprises a system for managing the robotic conveyors 90 and a system for managing the carousel-type parking towers.

The method provides for detecting the position of the at least one conveyor, and the position of the pods of the various towers, in particular, the position of the target pod.

Preferably, the method provides for simultaneously controlling the pods of several parking towers and one or more conveyors. The robot management system controls the autonomous guidance means of the conveyors. The system for managing carousel-type parking towers controls the means for actuating the tower.

Furthermore, wireless communication means between the control means and the means for guiding the conveyors allow transmission of the addresses of the target pods 60*c* to the conveyors 90.

The method makes it possible to coordinate and/or synchronize the movements of the transport robotic conveyors and the movements of the pods of the various carousel-type parking towers and thus propose a parking of the motor vehicles allowing, with regard to the prior art, storage and retrieval that is faster and safer for people while optimizing the space available.

The invention claimed is:

1. A method of parking motor vehicles of an automatic parking system allowing for storage and retrieval of motor vehicles, the automatic parking system comprising at least two carousel parking towers, each tower comprising:

a vertical frame having a number N of pod spaces, and, on a ground level, a tower entrance and a tower exit for passage of a vehicle;

at least N−1 pods connected to the vertical frame, each pod being connected to a pod space, each pod comprising a storage tray corresponding to a parking space of a motor vehicle and having a pod entrance and a pod exit for the passage of the vehicle; and a translational actuation mechanism for moving the pods in a closed path along the frame;

each pod being loaded or unloaded when placed on the ground level of the tower;

the at least two parking towers being arranged one behind the other, the at least two parking towers including at least one passage tower and one destination tower so that a tower exit of the at least one passage tower faces a tower entrance of the at least one destination tower so that a vehicle can pass directly from one of the at least two towers to another of the at least two towers, and defining a number R, R being equal to at least 2, of rows of parking towers, the at least one destination tower being positioned at least at row 2;

the parking system comprising at least one four-wheeled vehicle transport conveyor comprising wedging arms, arranged to be positioned on either side of the treads of the wheels of the vehicle so as to carry or deposit the vehicle, the at least one conveyor being autonomously guided;

the parking system comprising a control system configured to control the actuation mechanism of the at least two parking towers and the autonomously guided at least one conveyor;

the method comprising:

selecting a target pod of the at least one destination tower for storing or retrieving a vehicle;

controlling the actuation mechanism of the at least two parking towers, comprising moving of the pods of the at least one destination tower to place the target pod on the ground level, and moving of the pods of the at least one passage tower, so as to align an empty pod or the empty pod space of the at least one passage tower with the target pod of the destination tower; and controlling movement of the at least one conveyor, carrying a vehicle or being empty, to cause the at least one conveyor to pass through the at least one passage tower, and access the target pod of the destination tower to store or retrieve the vehicle.

2. The method of claim 1, further comprising detecting an empty pod or an empty pod space on the ground level of the at least one passage tower before controlling the movement of the at least one conveyor.

3. The method of claim 1, further comprising identifying the at least one conveyor during passage over a storage tray or the ground level of the at least one passage tower comprising an empty pod space.

4. The method of claim 1, wherein the parking system comprises a means of wireless communication between the control system and the at least one conveyor, the method further comprising transmitting an address of the target pod to the at least one conveyor.

5. The method of claim 1, wherein the parking system comprises a number L, L being equal to at least 2, of lines of at least two parking towers, arranged next to each other, each line of parking towers comprising the number R of rows of parking towers, and wherein the parking system comprises at least one transport conveyor per line of parking towers, the method further comprising simultaneously controlling movement of at least two transport conveyors.

6. An automatic parking lot system for storing and retrieving motor vehicles comprising:

at least two carousel parking towers arranged one behind the other, at least one of the at least two carousel parking towers comprising a passage tower and at least one of the at least two carousel parking towers comprising a destination tower so that a tower exit of the passage tower faces a tower entrance of the destination tower so that a transport conveyor that is or is not carrying a vehicle can pass directly from one of the passage tower and the destination tower to another of the passage tower and the destination tower, defining a number R, R being equal to at least 2, of rows of towers, the destination tower being positioned at least at row 2, each tower of the at least two towers including:

a vertical frame having a number N of pod spaces, and, on a ground level, a tower entrance and a tower exit for the passage of a vehicle;

at least N−1 pods connected to the frame, each pod being connected to a pod space, each pod comprising a storage tray corresponding to a parking space of a motor vehicle and having a pod entrance and a pod exit for the passage of the vehicle; and a translational actuation mechanism for moving the pods in a closed path along the frame, each pod being loaded or unloaded when it is placed on the ground level of the parking tower;

at least one four-wheeled vehicle transport conveyor comprising wedging arms, arranged to be positioned on either side of the treads of the wheels of the vehicle so as to carry or deposit the vehicle, the at least one transport conveyor being autonomously guided;

a control system configured to control the actuation mechanism and the autonomously guided at least one transport conveyor; and support means arranged on the ground level of each parking tower, the support means being arranged to at least partially support the weight of the at least one transport conveyor and a vehicle carried on the at least one transport conveyor.

7. The system of claim 6, wherein each parking tower further comprises an empty pod space, and the support means comprises a platform protruding from the ground level of the respective parking tower.

8. The system of claim 6, wherein each parking tower comprises N pods, and the support means comprises load-absorbing rollers protruding from the ground level of the respective parking tower.

9. The system of claim 6, wherein the parking lot system comprises a number L, L being equal to at least 2, of lines of parking towers, arranged next to each other, each line of parking towers comprising the number R of rows of parking towers.

* * * * *